US006477725B1

(12) United States Patent
Hong et al.

(10) Patent No.: US 6,477,725 B1
(45) Date of Patent: Nov. 12, 2002

(54) HEIGHT-ADJUSTABLE WASHSTAND

(75) Inventors: Soon-Jin Hong; Geun-Woo Chung, both of Seoul (KR)

(73) Assignee: Sung-il Ahn, Seoul (KR)

( * ) Notice: Subject to any disclaimer, the term of this patent is extended or adjusted under 35 U.S.C. 154(b) by 0 days.

(21) Appl. No.: 09/990,040

(22) Filed: Nov. 20, 2001

(30) Foreign Application Priority Data

Jul. 24, 2001 (KR) ..... 2001-22451

(51) Int. Cl.[7] ..... A47K 1/05
(52) U.S. Cl. ..... 4/645
(58) Field of Search ..... 4/645; 312/247, 312/398; 248/132, 157

(56) References Cited

U.S. PATENT DOCUMENTS 1,060,106 A * 4/1913 Maillette et al. ..... 4/645
3,011,177 A * 12/1961 Haughey ..... 4/645
3,456,264 A * 7/1969 Flagg ..... 4/645
3,473,173 A * 10/1969 Maciulaitis et al. ..... 4/645 X
5,230,109 A * 7/1993 Zaccai et al. ..... 4/645
5,867,847 A * 2/1999 Klawitter et al. ..... 4/645

* cited by examiner

*Primary Examiner*—Charles E. Phillips
(74) *Attorney, Agent, or Firm*—John A. Parrish; Maria Parrish Tungol

(57) ABSTRACT

The present invention relates to a height-adjustable washstand comprising a cylinder 20 containing a piston 21 integrally coupled with a lifting rod 22 which can be moved by water pressure in a vertical direction, and a compression spring 23; solenoid valves SA, SB for simultaneously controlling an amount of water supplied through a water supplying pipe 31 branched from and flexibly connected to a water main 11, and an amount of water discharged through a water discharging pipe 32; and booster tanks DA, DB for moving the piston 21 of the cylinder 20 in a vertical direction by means of water pressure that is provided by the operation of solenoid valves SA, SB.

5 Claims, 3 Drawing Sheets

HEIGHT-ADJUSTABLE WASHSTAND

BACKGROUND OF THE INVENTION

1. Field of the Invention

The present invention relates to a height-adjustable washstand of which the height can be adjusted by using a booster apparatus according to a demand of a user. More particularly, the present invention relates to a height-adjustable washstand wherein a user can conveniently and freely adjust the height of the washstand to be fit for a physical condition of the user by means of a correct up and down movement of a piston using water pressure.

2. Description of the Prior Art

In general, most conventional washstands are fixedly installed on a wall surface at a level suitable for an adult. Thus, the use of the washstand is inconvenient for a person of stature higher or lower than the installation level of the washstand. In addition, there is a problem in that children cannot utilize the conventional washstand.

On the other hand, various types of apparatuses for adjusting the height of such a washstand have been proposed. For example, Korean Utility Model Publication No. 89-9081 discloses a height-adjustable washstand wherein a rack is fixed behind a washstand so that the height of the washstand can be adjusted by using a pinion cooperating with the rack. However, the height thereof cannot be adjusted at intervals of a pitch of the rack. There is also inconvenience of use in that a ratchet gear should be separated when the washstand is moved downward. Further, since it is likely that if the ratchet gear is separated during use of the washstand, the washstand falls downward, there is a problem in that the degrees of convenience and safety are deteriorated in the washstand.

Moreover, Korean Utility Model Publication No. 87-1447 discloses a height-adjustable washstand shown in FIG. 3 wherein a washstand 1 is attached through a fixing piece 5 to an operating rod 4 of a piston 3 formed within a cylinder 2 so that the height of the washstand 1 can be adjusted by vertically moving the washstand by manipulation of actuation buttons 7, 8 of a compressor 6, as shown in FIG. 3. However, installation of the compressor 6 in the interior of a wall makes the construction works thereof cumbersome, and there is a structural limitation in that the washstand 1 is thrust downward due to its weight. Thus, the washstand has many problems in view of convenience of use and safety thereof.

SUMMARY OF THE INVENTION

Therefore, the present invention is conceived to solve the aforementioned problems in the prior art. The present invention provides a height-adjustable washstand wherein a user can correctly and stably adjust the height of the washstand to be fit for a physical condition of the user by freely adjusting the lift height of a piston by means of water pressure thereby enhancing the degrees of convenience and safety of the washstand.

A height-adjustable washstand of the present invention comprises a cylinder which is fixedly installed on the bottom of the washstand and contains a piston integrally coupled with a lifting rod and moved by water pressure in an up and down direction within the cylinder, and a compression spring; a rod casing with a lower portion thereof fixedly installed on a floor and with an upper portion thereof opened and constructed such that the lifting rod of the cylinder is inserted into the open upper portion of the rod casing to be moved in the up and down direction and to be fixed at a desired level in order to adjust the height of the lifting rod; solenoid valves of a valve body for simultaneously controlling an amount of water supplied through a water supplying pipe branched from and flexibly connected to a water main on the side of a wall, and an amount of water discharged through a water discharging pipe, by means of opening and closing operations of the solenoid valves; booster tanks of the valve body constructed such that pressure plates in the booster tanks are vertically moved by means of supply and discharge of the water of which amount is controlled by the solenoid valves in order to move the piston of the cylinder in the up and down direction by relevant water pressure; a power supply plug for supplying electric power to the solenoid valves that are opened and closed in opposite manners according to up and down movement of the piston; and a lift-operating switch for selectively actuating the up and down movement of the piston.

Further, it is preferred that the solenoid valves of the valve body be comprised of 4-way or 2-way solenoid valves which operate to be normally closed when they are not energized and to be opened when they are energized, or vice versa so that the water pressure can be controlled by supplying water to one of the booster tanks connected to upper and lower portions of the cylinder while discharging water from the other booster tank through the water discharging pipe in response to the up and down movement of the piston.

Furthermore, the water drain pipe of the washstand preferably has a telescopic structure so the length can be adjusted according to the up and down movement of the piston.

Moreover, front face and side faces of a space formed between the washstand and the floor are covered with and protected by a decorative cover having a two-stage structure as a whole, and the decorative cover is constructed such that an upper portion of the decorative cover attached to a front portion of the washstand can be telescopically guided and slid over outer surfaces of a lower portion of the decorative cover secured on the floor.

BRIEF DESCRIPTION OF THE DRAWINGS

The above object and feature of the present invention will become apparent from the following description of a preferred embodiment given in connection with the accompanying drawings, in which.

DETAILED DESCRIPTION OF THE INVENTION

Hereinafter, a preferred embodiment of a height-adjustable washstand according to the present invention will be described in detail with reference to the accompanying drawings. The preferred embodiment is described only by way of example in order to facilitate understanding of the operation principle of the present invention. It is not intended to limit the scope of the present invention.

Figure 1:
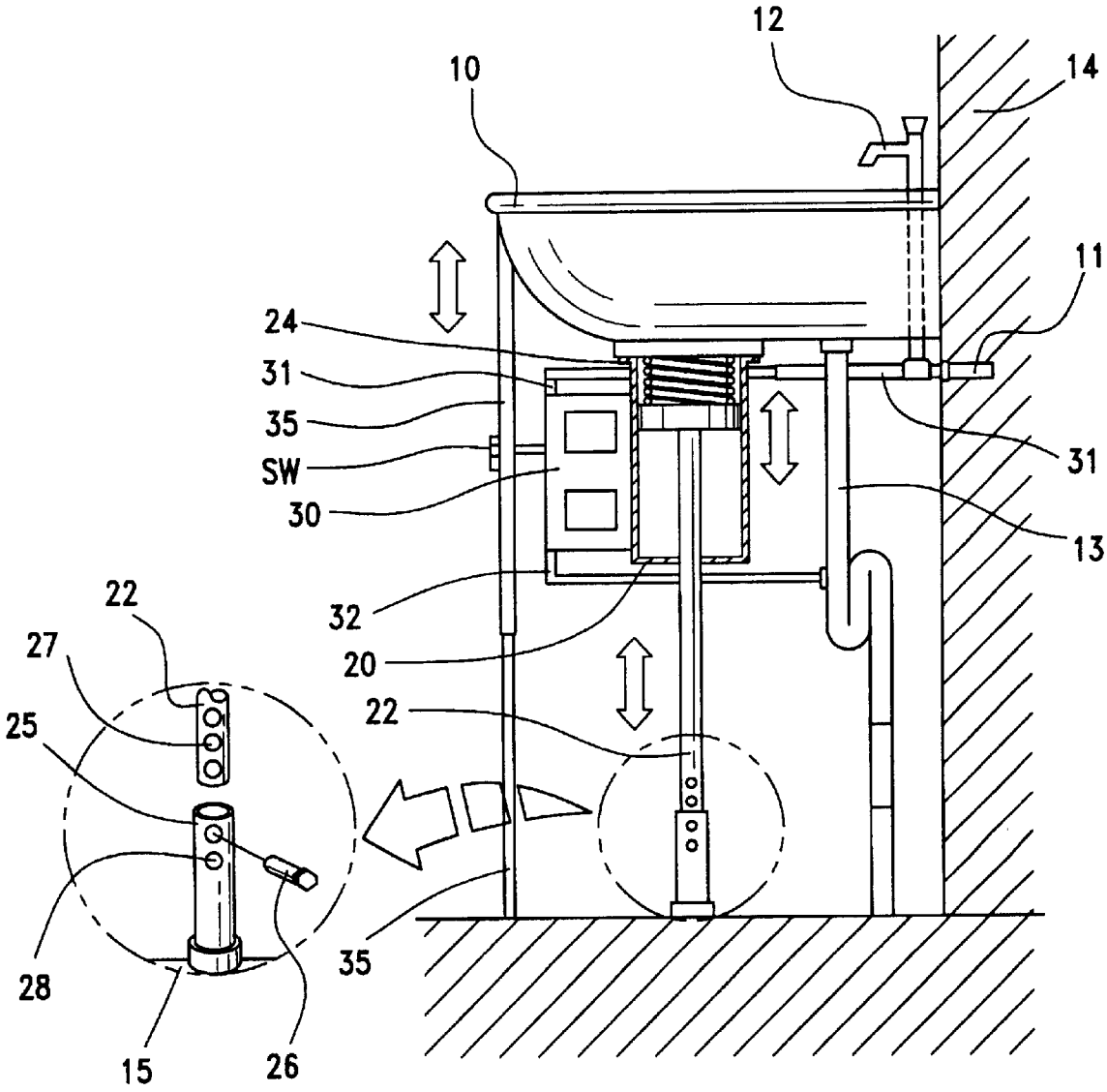
FIG. 1 is a side view of height-adjustable washstand according to the present invention that has been installed next to a wall.
Figure 2:
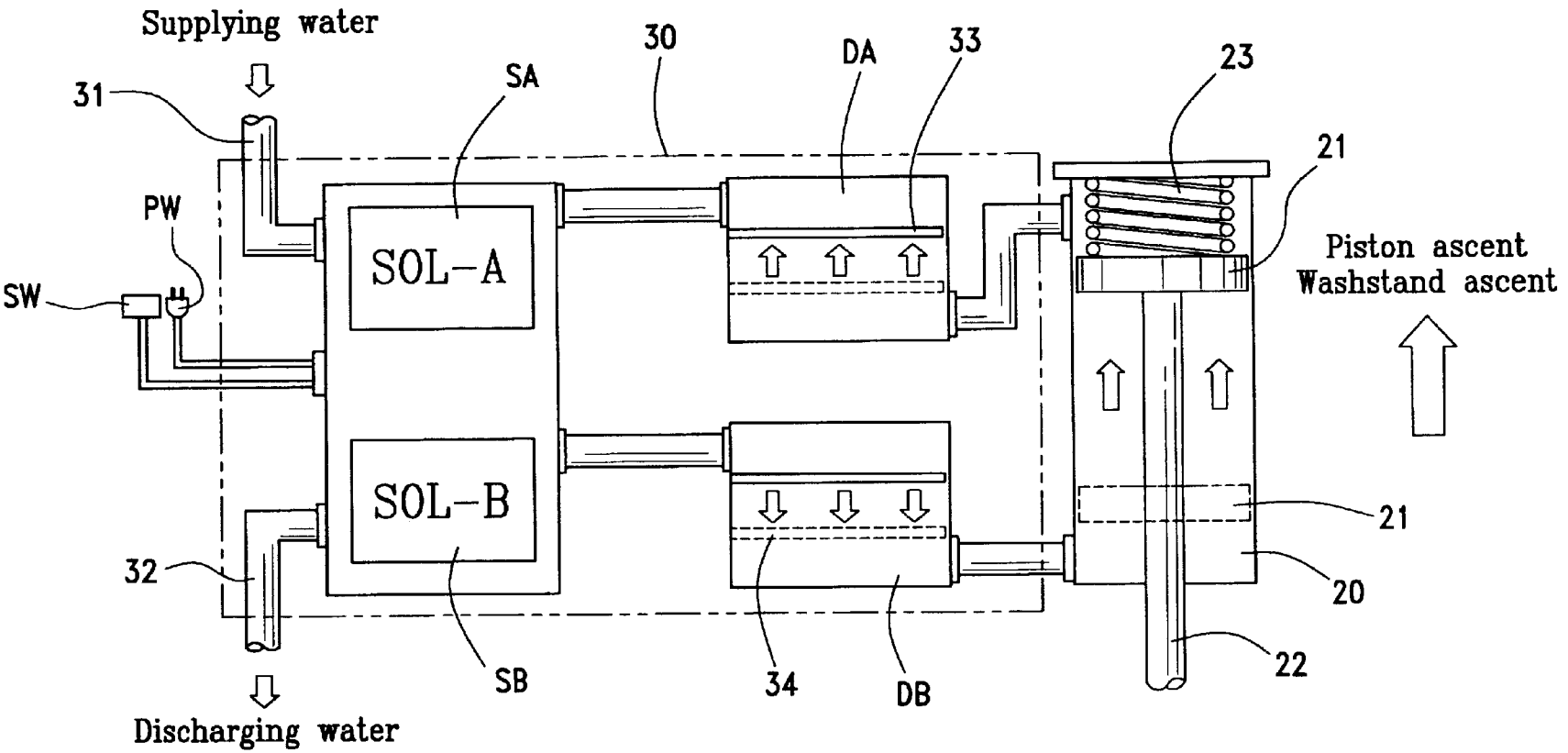
FIG. 2 is a schematic that shows an operating state of a valve body of the height-adjustable washstand according to the present invention.
Figure 3:
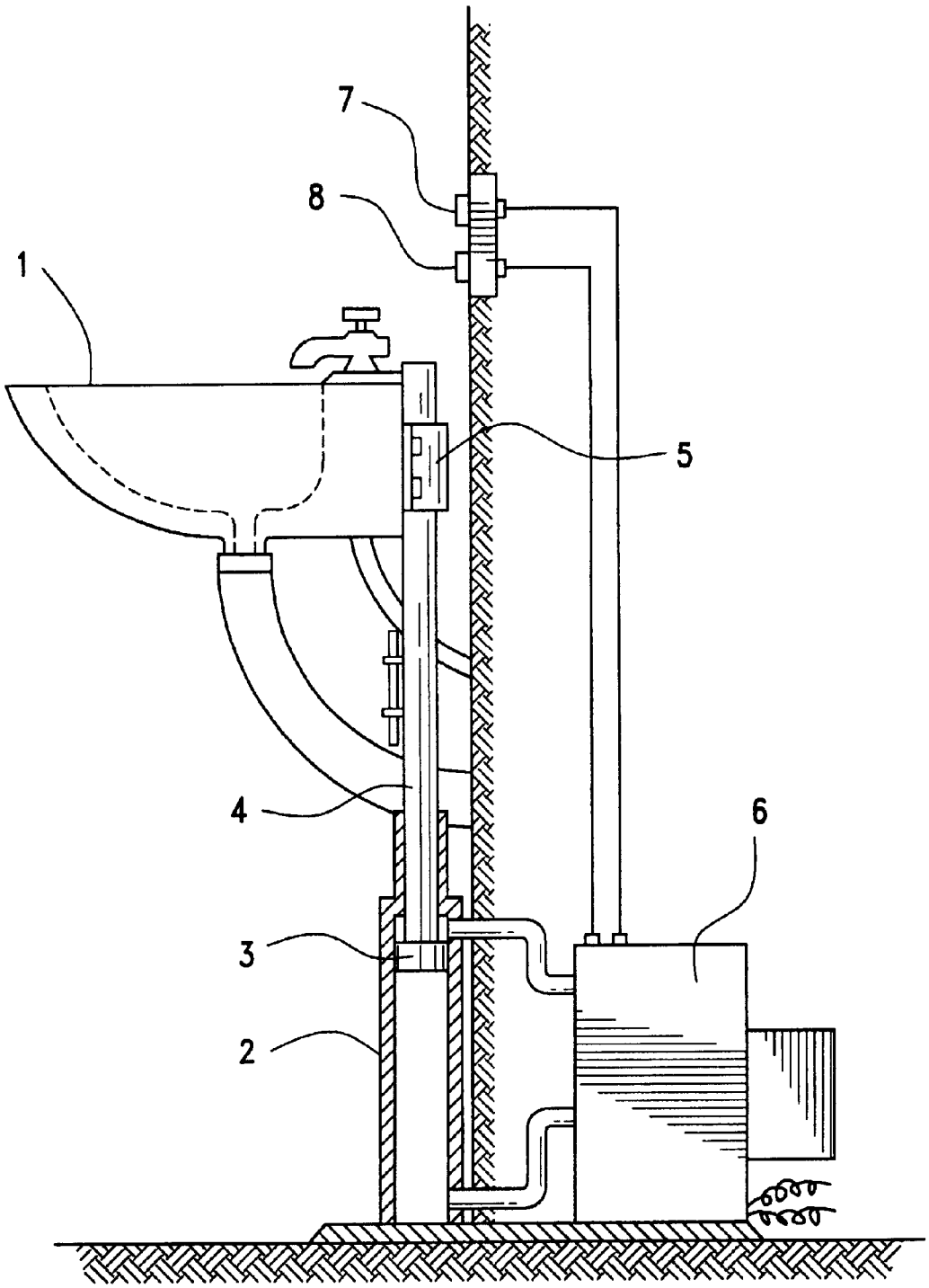
FIG. 3 (PRIOR ART)
FIG. 3 is a side view of a conventional height-adjustable washstand in the prior art.

FIG. 1 is a side view that shows an installation of a height-adjustable washstand 10 of which the height can be adjusted by using a booster apparatus, according to the present invention. FIG. 2 specifically shows the operating structure of a valve body 30 and a piston 21 which constitute a booster apparatus for adjusting the height of the washstand 10 according to the present invention by means of water pressure.

As shown in these figures, in addition to a water drain pipe 13, a cylinder 20 is installed on the bottom of the washstand 10 so that the piston 21 is moved vertically within the cylinder to adjust the height of the washstand 10. The piston 21 can be moved vertically by means of solenoid valves SA, SB, which can be opened and closed for controlling supply and discharge of water, and booster tanks DA, DB that serve to transfer water pressure generated in proportion to an amount of supplied water to the cylinder 20.

It is preferred that the solenoid valves SA, SB and the booster tanks DA, DB be arranged within the valve body 30 and fixedly attached to a side of the cylinder 20. The solenoid valves SA, SB are connected to a water supplying pipe 31 through which water is supplied from a water main 11, and to a water discharging pipe 32 through which water having been used for up and down movement of the piston 21 within the cylinder 20 is discharged. Particularly, since the water supplying pipe 31 is branched directly from the fixed water main 11, it is apparent that the water supplying pipe 31 is constructed by a flexible hose structure to be smoothly displaced depending on variation in the height of the valve body 30.

Further, the solenoid valves SA, SB of the valve body 30 can be opened and closed for simultaneously controlling an amount of water supplied through the water supplying pipe 31 branched from the water main 11 on the side of a wall 14, and an amount of water discharged through the water discharging pipe 32. It is preferred that in order to regulate the water pressure, the solenoid valves be constructed by 2-way solenoid valves which may operate to be in a normal closed state when they are not energized and to be opened when they are energized, or vice versa, so that they simultaneously allow water to be supplied to one of the booster tanks DB and to be discharged through the water discharging pipe 32 from the other booster tank DA. The solenoid valves may be constructed by 4-way solenoid valves, if necessary.

The booster tanks DA, DB of the valve body 30 are connected to and controlled by the solenoid valves SA, SB, respectively. The booster tanks DA, DB are constructed in such a manner that each of pressure plates 33, 34 in the respective booster tanks DA, DB is vertically moved in opposite directions by means of the supply and discharge of the water of which the amount is adjusted in accordance with operating time of a lift-operating switch SW, so that the piston 21 in the cylinder 20 can be vertically moved by means of the relevant water pressure. The booster tanks DA, DB are connected to upper and lower portions of the cylinder 20 with respect to the vertically movable piston 21, respectively.

The cylinder 20 fixedly installed on the bottom of the washstand 10 contains the piston 21, which is integrally coupled with a lifting rod 22 and can be vertically moved by means of the water pressure from the valve body 30, and a compression spring 23. Here, it is apparent that the length and the strength of the compression spring 23 are determined on the basis of calculation of static and dynamic loads of the washstand 10.

It is preferred that the lifting rod 22 extending from the cylinder 20 be constructed in such a manner that a lower end portion thereof is not in direct contact with a floor 15 and is inserted movably in the up and down direction into an open upper end portion of a rod casing 25 fixedly installed on the floor 15 in order to allow the height of the lifting rod 22 to be adjusted. At this time, the lower end portion of the lifting rod 22 and the upper end portion of the rod casing 25 are formed with a plurality of height-adjusting apertures 27, 28, respectively, to correspond to one another at predetermined intervals, and thus, a separable adjusting bolt 26 can be inserted into the pair of mated apertures 27, 28 at a desired height of the lifting rod 22.

Alternatively, the rod casing 25 may contain the compression spring 23 and the piston 21 for compressively supporting the lifting rod 22 at predetermined pressure in the same way as the internal structure of the cylinder 20. It is apparent that the rod casing 25 may employ various types of compressive supporting structures which allow the lifting rod 22 to be smoothly moved in the up and down direction and not to be damaged due to direct contact with the floor 15.

A power supply PW for supplying electric power to the solenoid valves SA, SB that are opened and closed in opposite manners according to the up and down movement of the piston 21, and the lift-operating switch SW for selectively activating the up and down movement of the piston 21 are provided in front of the valve body 30. Particularly, it is preferred that the lift-operating switch SW serving as an operating handle be a three-stage switch having upper and lower positions with respect to a central position corresponding to a stop position. At the upper and lower positions, the lift-operating switch SW energizes the relevant solenoid valves SA, SB and thus converts signals for the respective solenoid valves. It is also preferred that the lift-operating switch SW be installed on a decorative cover 35 disposed below and in front of the washstand 10 so that it is exposed to the outside for allowing a user to easily operate the switch.

For example, as can be seen from the operating structure of the valve body 30 shown in FIG. 1, when the lift-operating switch SW exposed to the exterior of the valve body 30 is switched from the central position to the upper position, the signals supplied to the solenoid valve SB connected to the lower booster tank DB are turned on so that the water is supplied to the booster tank DB. Then, the pressure plate 34 in the lower booster tank DB connected to the lower portion of the cylinder 20 is moved downwardly by means of water pressure applied by the supplied water so that the piston 20 is raised. On the contrary, the water pressure is transferred to the upper booster tank DA connected to the upper portion of the cylinder 20 and raises the pressure plate 33 therein upwardly.

That is, it is preferred that the solenoid valves SA, SB of which energization is selectively controlled by the lift-operating switch SW be connected to the respective upper and lower booster tanks DA, DB, or connected to the booster tanks therebetween. It is also preferred that the power supply plug PW for supplying the electrical power to the solenoid valves SA, SB be plugged into a receptacle (not shown) on the wall 14.

On the other hand, the water discharging pipe 32 extending from the valve body 30 is connected to an intermediate portion of a water drain pipe 13 so that the water, which has been used for the up and down movement of the washstand 10, can be discharged to the outside through the water drain pipe 13 of the washstand 10. In addition, it is preferred that the water drain pipe 13 has a telescopic structure so that the length of the water drain pipe 13 can be adjusted according to the up and down movement of the piston 21.

The front face and side faces of a space formed between the washstand 10 and the floor 15 are covered with and protected by the decorative cover 35 preferably having a two-stage structure as a whole. Preferably, the decorative cover 35 is constructed such that an upper portion thereof attached to a front portion of the washstand 10 can be telescopically guided and slid over outer surfaces of a lower portion of the decorative cover secured on the floor 15. That is, it is preferred that the upper portion of the decorative cover 35 be made to be relatively larger than the lower portion thereof so that water is structurally prevented from penetrating into a coupling portion of them.

Further, the decorative cover 35 is generally made in the shape of "C" to protect most components arranged in the space between the washstand 10 and the floor 15 and simultaneously to provide a decorative function. That is, it is apparent that the decorative cover seals and protects the front face and the side faces of the space except for the rear face thereof opposite to the wall 14, while maintaining drain gaps between the sides of the decorative cover and the rear wall 14.

Moreover, the upper and lower ends of the decorative cover 35 are coupled with the washstand 10 and the floor 15 by means of fixing bolts 24 in the same way as the cylinder 20. A conventional faucet 12 is provided above the washstand 10 and is separate from the water supplying pipe 31.

According to the height-adjustable washstand of the present invention constructed as such, when a user turns on the lift-operating switch SW serving as an operating handle by switching the lift-operating switch to the upper position thereof, the lower solenoid valve SB is energized, and then, the tap water is supplied through the water supplying pipe 31 to the lower booster tank DB connected to the lower portion of the cylinder 20 and urges the pressure plate 34 downwardly. The water pressure transferred from the booster tank DB raises the piston 21 in the cylinder 20 upwardly.

Subsequently, the lifting rod 22 integrally formed with the piston 21 is raised toward the washstand 10 along with the upward movement of the piston 21. At the same time, the washstand 10 placed above the cylinder 20 is also raised upwardly by the lifted distance of the lifting rod 22. At this time, the lifted height of the washstand 10 can be adjusted according to the amount of water supplied during the operating duration of the lift-operating switch SW pressed by the user.

Moreover, the upward movement of the piston 21 causes the compression spring 23 placed at the upper portion of the cylinder 20 to be compressed, and the water pressure in the compression operation is transferred to the upper booster tank DA. The pressure plate 33 in the booster tank DA is raised upwardly by means of the transferred water pressure, and the water filled in an upper space of the booster tank DA with respect to the pressure plate 33 is discharged to the outside through the water discharging pipe 32 opened by the upper solenoid valve SA.

On the other hand, in order to lower the height of the washstand 10, when the user turns on the lift-operating switch SW serving as the operating handle by switching the lift-operating switch SW to the lower position thereof, the lifting rod 22 in the cylinder 20 is moved downwardly by means of the valve body 30 constructed by the solenoid valves SA, SB and the booster tanks DA, DB, in an operating manner opposite to the aforementioned lifting operation of the washstand 10. Thus, the height of the washstand 10 is correctly and smoothly lowered.

As described above, according to the height-adjustable washstand of the present invention, the user can easily, conveniently, and freely adjust the height of the washstand to be fit for a physical condition of the user by means of the correct up and down movement of the piston due to the water pressure. Accordingly, since the height of the washstand can be adjusted by means of the water pressure, the simple and correct adjustment of the height can be obtained and thus the structural stability and convenience of use of the washstand can be maximized.

Consequently, since children, and a tall or short person can adapt the washstand to their own physical conditions, particularly in case of children, it is possible to eliminate inconveniences that the children should receive help from an adult or use an additional stool, and a safety accident resulting therefrom. Furthermore, there is an advantage in that the washstand can be safely utilized without a structural failure in operation.

On the other hand, the above embodiment is a preferred embodiment for facilitating understanding of the present invention, and different structures capable of adjusting the height of the washstand by means of the booster apparatus using the solenoid valves may be embodied without departing from the operating principle of the present invention. It should be understood that all embodiments and modifications thereof which can be made without departing from the operating principle of the present invention fall within the scope of the present invention.

Specifically, since the height of the washstand is adjusted by the lifting rod and the washstand is fixedly supported by the lifting rod and the water drain pipe, the fixed state of the washstand of the present invention may be somewhat inferior to that of a conventional fixed-type washstand. However, although it has not been described in the preferred embodiment, it is apparent that this problem can be solved by installing an additional supporting means such as a dovetail structure or guide rail structure at a position below and in rear of the washstand on the side of the wall. In a case where the valve body are constructed without the booster tanks, the height of the washstand may be adjusted by regulating the water pressure through the opening and closing operations of the solenoid valves.

What is claimed is:

1. A height-adjustable washstand, comprising:

a cylinder 20 fixedly installed on the bottom of a washstand 10, said cylinder containing a piston 21 integrally coupled with a lifting rod 22 and a compression spring 23, said piston being moved by water pressure in an up and down direction within said cylinder;

a rod casing 25 having an open upper portion and a lower portion thereof fixedly installed on a floor 15 and, said lifting rod 22 of said cylinder 20 being inserted into said open upper portion of said rod casing 25 to be moved in said up and down direction and to be fixed at a desired level so that the height of said lifting rod can be adjusted;

solenoid valves SA, SB of a valve body 30 for simultaneously controlling an amount of water supplied through a water supplying pipe 31 flexibly connected to a water main 11 on the side of a wall 14 and for controlling an amount of water discharged through a water discharging pipe 32, by means of opening and closing operations of said solenoid valves;

booster tanks DA, DB of said valve body 30 constructed such that pressure plates 33, 34 in said booster tanks are vertically moved by means of supply and discharge of said water controlled by said solenoid valves SA, SB in order to move said piston 21 of said cylinder 20 in said up and down direction by water pressure;

a power supply PW for supplying electric power to said solenoid valves SA, SB that are opened and closed in opposite manners according to up and down movement of said piston; and a lift-operating switch SW for selectively actuating said up and down movement of said piston 21.

2. The height-adjustable washstand as claimed in claim 1, wherein said solenoid valves SA, SB of said valve body 30 are comprised of 4-way or 2-way solenoid valves which are closed when they are not energized and are opened when they are energized, so that said water pressure can be controlled by supplying water to one of said booster tanks DA or DB connected to upper and lower portions of said cylinder 20 while discharging water from the other booster tank DB or DA through said water discharging pipe 32 in response to said up and down movement of said piston 21.

3. The height-adjustable washstand as claimed in claim 1, wherein said solenoid valves SA, SB of said valve body 30 are comprised of 4-way or 2-way solenoid valves which operate to be open when they are not energized and are closed when they are energized so that said water pressure can be controlled by supplying water to one of said booster tanks DA or DB connected to upper and lower portions of said cylinder 20 while discharging water from the other booster tank DB or DA through said water discharging pipe 32 in response to said up and down movement of said piston 21.

4. The height-adjustable washstand as claimed in claim 1, wherein a water drain pipe 13 of said washstand has a telescopic structure so that the length of water drain pipe 13 can be adjusted according to said up and down movement of said piston 21.

5. The height-adjustable washstand as claimed in claim 1, wherein front and side faces of a space formed between said washstand 10 and said floor 15 are covered by a decorative cover 35 wherein said decorative cover 35 has an upper portion attached to a front portion of said washstand 10 and a lower portion, wherein the upper portion can be telescopically guided and slid over an outer surface of the lower portion of said decorative cover.

* * * * *